United States Patent [19]

Falgares

[11] 4,311,078

[45] Jan. 19, 1982

[54] BOW PLAYABLE GUITAR

[76] Inventor: Frank Falgares, 238 Franklin St., Bloomfield, N.J. 07603

[21] Appl. No.: 249,181

[22] Filed: Mar. 30, 1981

Related U.S. Application Data

[63] Continuation-in-part of Ser. No. 140,297, Apr. 14, 1980, abandoned.

[51] Int. Cl.[3] ..... G10D 3/06

[52] U.S. Cl. ..... 84/314 R; 84/267; 84/307; 84/314 N

[58] Field of Search ..... 84/173, 267–268, 84/290, 293, 298–299, 307, 314

[56] References Cited

U.S. PATENT DOCUMENTS

| | | | |
|---|---|---|---|
| 511,009 | 12/1893 | Bocker | 84/291 X |
| 554,828 | 2/1896 | Maldura | 84/307 |
| 2,905,042 | 9/1959 | Hoyer | 84/307 |
| 3,273,439 | 9/1966 | Keefe et al. | 84/314 R |
| 3,319,504 | 5/1967 | Appleton | 84/314 R |

FOREIGN PATENT DOCUMENTS

| | | | |
|---|---|---|---|
| 351756 | 6/1921 | Fed. Rep. of Germany | 84/314 R |
| 456051 | 6/1913 | France | 84/314 R |

*Primary Examiner*—Lawrence R. Franklin
*Attorney, Agent, or Firm*—McAulay, Fields, Fisher

[57] ABSTRACT

A guitar is provided which, while being held in the traditional guitar playing position, may be strummed or bowed interchangeably, as desired. This is accomplished by constructing the nut, neck and bridge each to be formed having an arcuate surface to support the strings in an arcuate disposition. Furthermore, when the guitar is held in the traditional, generally vertical position, the corresponding upper edge portions of the nut, neck and bridge are raised so as to be greater in height than the opposite edge portions thereof to locate the arcuate surfaces asymmetrically relative to the body of the instrument to support the strings either for strumming, plucking or bowing.

8 Claims, 6 Drawing Figures

BOW PLAYABLE GUITAR

CROSS-REFERENCE TO RELATED APPLICATION

This application is a continuation-in-part of U.S. Application Ser. No. 140,297, filed Apr. 14, 1980, now abandoned.

BACKGROUND OF THE DISCLOSURE

The present invention is concerned generally with a guitar type stringed instrument, and more particularly, with a guitar which may be played either by strumming or bowing.

Prior art guitars, which are intended to be played by strumming or plucking of the strings, are generally formed with a substantially flat shaped neck, nut and bridge. That is, the strings are normally supported by the nut and bridge with the strings lying in spaced apart relation in substantially the same plane. In this context, the term "neck" is taken to mean the top surface thereof over which the strings lie, which surface is commonly identified as the fingerboard. Although some guitars are made with the top neck surface having a slight curvature, such as shown in U.S. Pat. No. 4,069,732, the curvature is not sufficient to permit the guitar strings to be played with a bow.

To play any stringed instrument with a bow, such as a violin, cello or bass violin, it is necessary that there be sufficient space (height and width) between adjacent strings so that each string can be played individually with the bow. For these instruments, it is usual to provide supporting structure to support the strings in substantially a symmetrical arc relative to the body portion of the instrument. However, since the guitar is not intended to be played with a bow, its string supporting structure is traditionally different from that of the above stringed instruments. The present invention enables the guitar to be played either by strumming or bowing while being held in the traditional manner. Such an instrument has a unique sound in that it can be used to produce various unusual effects either by strumming or bowing the strings interchangeably, as desired. When used with a microphone pickup or a traditional sounding box, the resulting instrument can produce a myriad of unique sounds and has great versatility as a musical instrument not previously available with prior guitar structures.

BRIEF DESCRIPTION OF THE INVENTION

The guitar according to the present invention is provided with a nut, neck and bridge each having an arcuate surface to support the strings in a spaced apart and arcuate disposition. The normally upper edge portions of the nut, bridge and neck, that is, the edges which are on the upper side of the guitar when it is in its normal, generally vertical playing position, are raised so as to be greater in height than the opposite edge portions to locate the arcuate surfaces asymmetrically relative to the body or sounding board of the instrument. This supports the strings at an angle necessary to permit them to be bowed. In this regard, the body portion or sounding board is cut back at the edges to provide clearance for the bow. The structure enables the guitar to be held in the traditional manner for plucking or strumming, while alternatively permitting the player to bow the strings without significantly changing the position of the instrument.

The above and other objects, features and advantages of the present invention will become more apparent from a consideration of the following detailed description when taken in conjunction with the accompanying drawings.

DESCRIPTION OF THE PREFERRED EMBODIMENT

Figure 1:
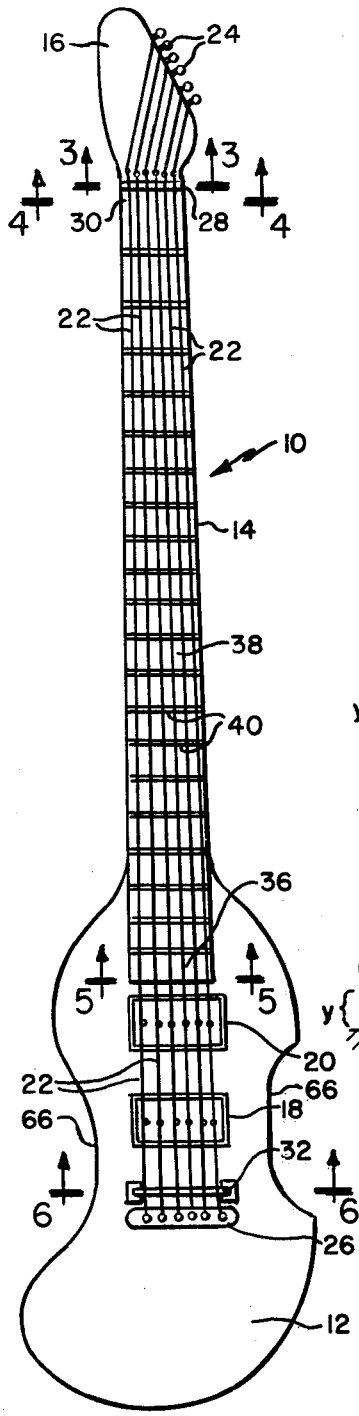
FIG. 1 is a frontal view of a guitar constructed in accordance with the present invention.

The present invention relates to a guitar 10 having an arcuate string supporting system to permit playing by bowing or by plucking, as desired. With reference to the drawings, and as is generally customary for instruments of this kind, the guitar 10 of the present invention has a body or sounding board 12 from which extends a neck 14 supporting a head 16 at its far end. As illustrated, the guitar is a nonacoustical or electric guitar having magnetic electric pick-up devices 18, 20 in the sounding board thereof. It is noted that the present invention also is applicable to acoustical type guitars.

Figure 6:
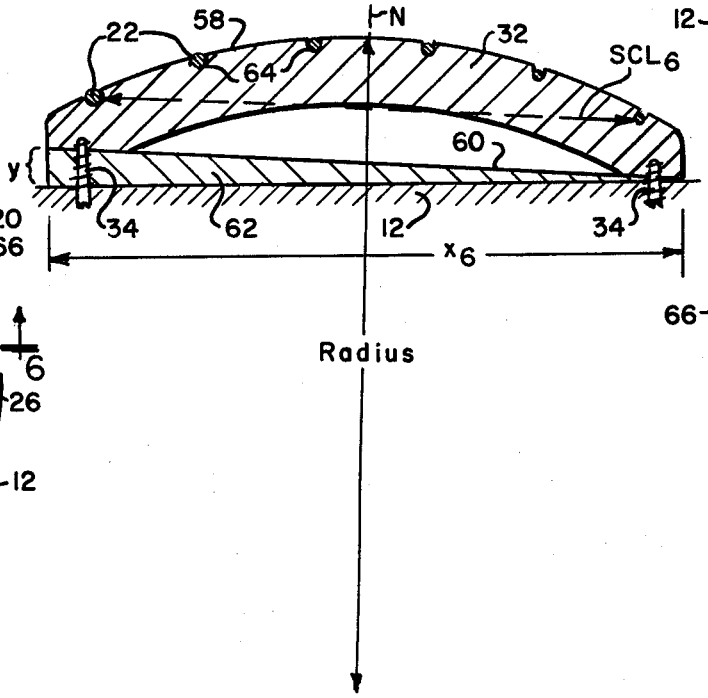
FIG. 6 is a sectional view of the bridge taken through line 6—6 of FIG. 1.
Figure 2:
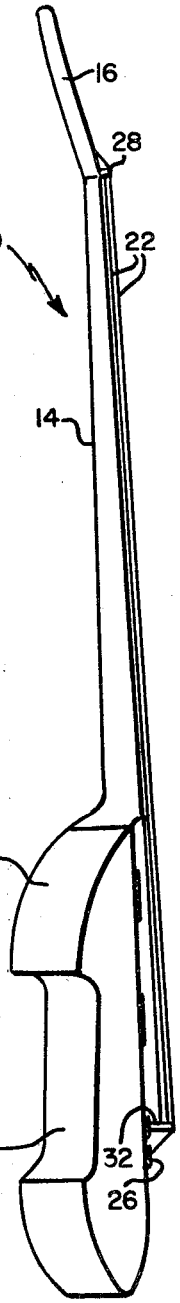
FIG. 2 is a side view thereof.

A plurality of strings 22 ranging from bass to treble are anchored between tuning pegs 24 on the head 16 and a tail piece 26 on body portion 12. The strings 22 pass over a string supporting system formed by a nut 28 adjacent to upper portion 30 of neck 14 and a bridge 32 located adjacent to tail piece 26. Bridge 32 extends outwardly of the sounding board 12 and may be supported and adjusted in conventional manner by adjusting screws 34 (FIG. 6).

The neck 14 of guitar 10 has a lower portion 36 extending partially into the sounding board 12 for strength, as is usual in a guitar. The top surface of the neck 14 represents the fingerboard 38. Frets 40 are secured to the neck 14 and project outwardly of fingerboard 38. The upper portion 30 of neck 14 is connected to the head 16 which supports the string adjusting or tuning pegs 24. The nut 28 is secured to the head 16 adjacent the neck upper portion 30. The nut 28, in combination with bridge 32, supports the plurality of strings 22 above fingerboard 38 in the manner hereinafter described.

The guitar 10 is tuned by turning the adjusting pegs 24 as required. The nut 28 adjacent the upper neck portion 30, in combination with the bridge 32, aligns and supports the strings 22 spaced above the neck fingerboard 38, against which they are pressed during playing of the guitar 10.

In order to permit bowing of the strings 22, they are supported in an arcuate arrangement and spaced substantially an equal angular distance apart from each other along the arc. This separates the strings sufficiently to permit them to be bowed individually. While in such arcuate arrangement, the strings 22 are still disposed for strumming or plucking. The arcuate arrangement or disposition of the strings 22 is accomplished by the unique structure of the nut 28, neck 14 and bridge 32 illustrated more clearly in FIGS. 3, 4, 5 and 6.

Figure 3:
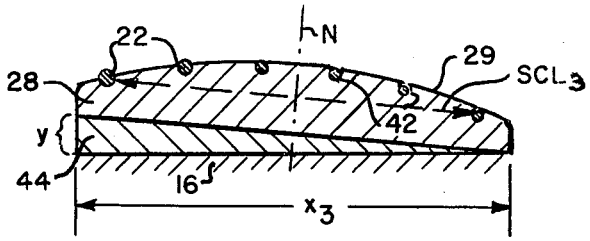
FIG. 3 is a sectional view of the nut taken through line 3—3 of FIG. 1.

An important structural feature of the present invention, as distinguished from guitars of the prior art, resides not only in the arcuate disposition of the nut 28, neck 14 and bridge 32, but also in the provision which raises one corresponding edge of the nut 28, neck 14 and bridge 32 to locate the arcuate surfaces of said elements asymmetrically relative to body 12. Referring to FIG. 3, the nut 28 has an arcuate surface 29 formed with a plurality of recesses 42 sized to receive or retain portions of the strings 22 therein. In order to raise one edge of nut 28, a wedge member 44 having an edge height represented by the letter y is positioned between nut 28 and the top surface of head 16. This serves to locate and support the strings 22 in the proper orientation for passing over the neck 14 of the guitar.

Figure 4:
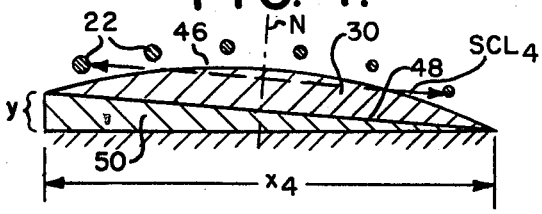
FIG. 4 is a sectional view of the upper neck portion taken through line 4—4 of FIG. 1.

In FIG. 4, the upper portion 30 of neck 14 has a top arcuate surface 46 which is illustrated as being symmetrical with respect to a line N normal to the chord line 48. One edge of top neck portion 30, corresponding in position to the said one edge of nut 28, is similarly raised a distance or height y by means of wedge member 50 positioned between top portion 30 and a flat surface of neck 14.

Figure 5:
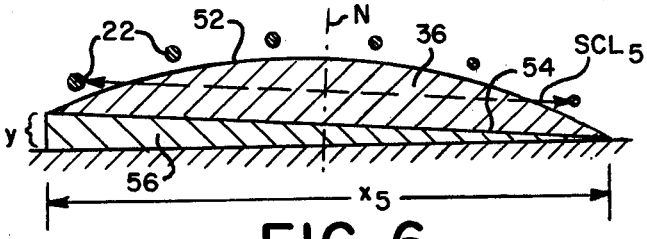
FIG. 5 is a sectional view of the extended lower neck portion taken through line 5—5 of FIG. 1.

In FIG. 5, the lower portion 36 of neck 14 is shown having a top arcuate surface 52 which, similar to the arcuate surface 46 of upper neck portion 30, is symmetrical with respect to the line N normal to the chord line 54. The left-sided edge as viewed in the drawings, similar to those referred to above, is also raised a distance or height y by wedge member 56. In FIGS. 4 and 5, the arcuate surfaces 46 and 52 also constitute fingerboard surfaces of neck 14.

In FIG. 6, the bridge 32 also has an arcuate surface 58 which is symmetrical with respect to the line N normal to the line 60. Here, again, the left-sided edge is raised a distance y by wedge member 62 located between bridge 32 and the top surface of body 12.

The height y is the same for the wedge members 44, 50, 56 and 62 to insure proper tonality and consistent height of strings 22 above fingerboard 38 when playing the instrument. The height y is between 1/16 and $\frac{1}{4}$ inch, and preferably in the order of $\frac{1}{8}$ inch. This has the effect of supporting the strings 22 at a convenient angle for proper bowing of the strings when the guitar 10 is held in the traditional manner.

It will be appreciated that rather than providing separate wedge members for the respective elements representing the nut, the neck and the bridge, these elements can be formed integrally with the respective wedge members to form a unitary structure for each of said elements.

In the drawings, the raised edges of nut 28, neck 14 and bridge 32 are illustrated as being on the left side of guitar 10, as viewed in FIG. 1, which corresponds to the upper side of the guitar when it is held by a right-handed player in its normal vertical playing position. That is, the raised edge is adjacent to the larger diameter bass strings of the instrument as viewed in FIGS. 3–6. In those instances where the player is left-handed, the raised edge portions would be reversed so as to be located on the right side of guitar 10, as viewed in the drawings.

The bridge 32 is formed with a plurality of recesses 64 sized to receive or retain portions of the strings 22 therein. The strings 22 thus are held in the arcuate and spaced apart positions by the recesses 64 in bridge 32 and the recesses 42 in nut 28. This serves to restrain sliding movement of the strings 22 when acted upon by the bow.

The body 12 of guitar 10 is provided with side indentations or cut-out portions 66 to accommodate travel of the bow when used on the strings 22. The cut-out portion 66, together with the asymmetrical disposition of the arcuate surfaces of neck 14 and bridge 32, allow proper bowing of strings 22 without the need to extend the player's elbow excessively outwardly.

The curvature of the nut 28, neck 14 and bridge 32 is shown in FIGS. 3, 4, 5 and 6. Referring to FIG. 4, the arcuate arrangement or disposition of strings 22 is such to locate a line drawn from the left-most string to the right-most string spaced from and parallel to chord line 48. In a guitar, these outer strings are known as the bass E string and the treble E string, respectively. The line drawn through these outer strings is herein defined as the string chord line (SCL), which is identified in FIG. 4 as line $SCL_4$ having a length in the order of 1 and $\frac{3}{8}$th inches. The radius of the arc comes within a range of between 1 and $\frac{1}{2}$ inches and 2 and $\frac{1}{4}$ inches, preferably in the order of 1 and $\frac{3}{4}$ inches. The base line dimension $x_4$ is about 1 and $\frac{5}{8}$th inches.

The base line dimension $x_3$ of the wedge 44 in FIG. 3 essentially corresponds to that of the base line dimension $x_4$ in FIG. 4, being in the order of approximately 1 and 9/16th inches. Furthermore, the string chord line dimension $SCL_3$ corresponds in length to that of $SCL_4$, namely, 1 and $\frac{3}{8}$th inches, and the radius of the arc of the nut 28 in FIG. 3 corresponds to that of the upper neck portion 30 in FIG. 4, being in the order of 1 and $\frac{3}{4}$ inches. The height of the nut 28 is suitably selected to guide the spaced strings at a proper distance above head 16 to the turning pegs 24.

It will be appreciated that the term "base line" merely represents a convenient reference line for comparing corresponding dimensions of the elements shown in the Figures. The base line can be taken as lying in a plane substantially parallel to the plane defined by the face of the guitar body or sounding board. In reality, the face may be somewhat curved. However, for purposes of discussion, the face is taken as being substantially flat. Accordingly, in describing the arcuate surfaces as being asymmetrically relative to the body 12 of the guitar 10, it is to be understood that the asymmetrical disposition is more correctly illustrated and depicted with respect to the reference line of said arcuately shaped elements.

In FIG. 5, the string chord line dimension $SCL_5$ is approximately 1 and $\frac{7}{8}$th inches. The radius of the arc, again, is in the order of 1 and $\frac{3}{4}$ inches, and the base line dimension $x_5$ is about 2 and $\frac{1}{8}$th inches. The height of the arcuate surface of neck 14 above the chord line 48 of FIG. 4 and above the chord line 54 of FIG. 5, taken in each case at the mid-point of the arc along line N, graduates at a steady ratio from the upper neck portion 30 to the lower neck portion 36.

Referring to the bridge 32 in FIG. 6, the string chord line dimension $SCL_6$ is approximately 2 and 1/16th inches. The radius of the arc, again, is in the order of 1 and $\frac{3}{4}$ inches and the base line dimension $x_6$ is about 2 and $\frac{3}{8}$th inches. As noted in the drawings, the string chord lines are parallel to the chord lines of the respective arcuate surface portions of the nut, neck and bridge in FIGS. 3–6.

In considering the height of the arcuate surface of neck 14 above the chord line 48 of FIG. 4 to the height of the bridge above line 60 in FIG. 6, again taken at the mid-point of the arc along line N, it can be considered that such height dimensions graduate continuously from the upper neck portion 30 to the bridge 32. It also will be appreciated that the arcuate surfaces of nut 28, neck 14 and bridge 32 each have the same radius of curvature. This serves to locate the strings 22 at a constant height above fingerboard 38 for the entire length of said fingerboard to insure correct string length between the frets 40 and the bridge 32 or tail piece 26 to achieve proper tonality when playing the guitar. The arcuate extent of such arcuate surfaces will come within the range of 45 degrees to 110 degrees depending on the spacing desired between the strings to facilitate the bowing operation. For the construction of bridge 32 in FIG. 6, the preferred arcuate extent is approximately 60 degrees.

The above dimensions are for a typical guitar such as one having an overall length from nut 28 to the bridge 32 of about 25 inches, and can be altered as required.

The frets 40 permit traditional fingering of the guitar strings when they are strummed or bowed. The frets are preferably shaped and formed in a manner similar to the curvature of neck 14 although they will be progressively longer in length as you move toward the bridge 32, and will extend slightly above the top surface of fingerboard 38 as is usual for guitars. Magnetic pickup devices 18, 20, if used, can be of any usual construction although it will be necessary to alter the disposition of the magnets to account for the positioning and arcuate curvature of the strings.

There is thus provided a guitar of unique construction whereby the guitar may be played either by strumming or plucking or bowing while the guitar is held in a traditional manner. While a preferred embodiment of the invention has been shown and described in detail, it will be readily understood and appreciated that numerous omissions, changes, and additions may be made without departing from the spirit and scope of the present invention.

What is claimed is:

1. In a guitar having a head portion with tuning pegs, a neck having a fingerboard, a nut at one end of the neck adjacent the head, a body portion, an anchor tail piece on the body and a bridge on said body between the tail piece and the other end of the neck, with a plurality of strings ranging from bass to treble extending between the tuning pegs and the tail piece and over the nut and bridge, wherein the improvement comprises:

(a) said nut, said neck and said bridge each having an arcuate surface portion;

(b) said nut and said bridge each further having recesses for receiving portions of said strings to support said strings in a spaced apart and an arcuate disposition relative to the arcuate surface portion of said neck; and (c) said nut, said neck and said bridge each further having a corresponding first edge portion greater in height than the opposite edge portion, said first edge portions being located adjacent the bass strings of the guitar and being disposed on the upper side of the guitar when the guitar is in its vertical playing position, the arcuate surface portions of said nut, said neck and said bridge being positioned asymmetrically relative to the plane of said body, said strings being supported at an angle to facilitate bowing while the guitar is held in a traditional manner whereby the guitar may be played either by strumming, plucking or bowing.

2. The guitar of claim 1 wherein the arcuate surface portions of said nut, said neck and said bridge each have the same radius of curvature.

3. The guitar of claim 2 wherein said radius of curvature is between 1 and ½ inches and 2 and ¼ inches.

4. The guitar of claim 1, 2 or 3 wherein said arcuate surface portions extend over an arcuate distance between 45 degrees and 110 degrees.

5. The guitar of claim 1 or 2 wherein the arcuate extent of said surface portions is defined by chord lines, and wherein the arcuate surface portion of said neck has a height above the chord line taken at the mid-point of the arc which increases continuously from the end adjacent said nut to the opposite end adjacent said bridge.

6. The guitar of claim 5 wherein the arcuate extent of said strings is defined by chord lines drawn between the outermost strings of said plurality of strings, said string chord lines being parallel to the chord lines of said arcuate surface portions.

7. The guitar of claim 6 wherein the lengths of said string chord lines are between 1 and ⅜th inches and 2 and 1/16th inches.

8. The guitar of claim 1 wherein each of said corresponding edge portions of said nut, said bridge and said neck are of a height between 1/16th and ¼ inches greater than that of the opposite edge portions thereof.

* * * * *